US005503379A

United States Patent [19]

Michalik et al.

[11] Patent Number: 5,503,379

[45] Date of Patent: Apr. 2, 1996

[54] CROSS FOLDING DEVICE WITH SHIFTABLE FORMERS

[75] Inventors: Horst B. Michalik, Höchberg; Otto T. Weschenfelder, Würzburg, both of Germany

[73] Assignee: Koenig & Bauer Aktiengesellschaft, Wurzburg, Germany

[21] Appl. No.: 361,285

[22] Filed: Dec. 22, 1994

[30] Foreign Application Priority Data

Dec. 24, 1993 [DE] Germany ..... 43 44 362.1

[51] Int. Cl.[6] ..... B41F 13/58; B41L 43/04

[52] U.S. Cl. ..... 270/5; 270/41; 493/479; 493/357

[58] Field of Search ..... 270/5, 6, 7, 8, 270/9, 41; 493/356, 357, 358, 359, 360, 439, 440, 476, 479

[56] References Cited

U.S. PATENT DOCUMENTS

| | | | |
|---|---|---|---|
| 1,770,350 | 7/1930 | Jordhoy | 493/440 X |
| 5,176,371 | 1/1993 | Rau et al. | 270/41 X |
| 5,303,909 | 4/1994 | Maylaender . | |
| 5,328,437 | 7/1994 | Maylander et al. | 493/357 |
| 5,439,206 | 8/1995 | Raasch et al. | 270/8 |

FOREIGN PATENT DOCUMENTS

| | | |
|---|---|---|
| 724900 | 9/1942 | German Dem. Rep. . |
| 594422 | 3/1934 | Germany . |
| 4128797 | 3/1993 | Germany . |
| 56-65760 | 6/1981 | Japan . |
| 437858 | 11/1935 | United Kingdom . |

OTHER PUBLICATIONS

Patent Abstracts of Japan; Pub. No. JP56065760; App. No. JP–790137694 dated Oct. 26, 1979; vol. 5, No. 127.

Patent Abstracts of Japan; Pub. No. JP57013053; App. No. JP–800084693 dated Jun. 23, 1980; vol. 6, No. 74.

Patent Abstracts of Japan; Pub. No. JP57151565; App. No. JP–810033878 dated Mar. 11, 1981; vol. 6, No. 256.

*Primary Examiner*—John E. Ryznic
*Attorney, Agent, or Firm*—Jones, Tullar & Cooper

[57] ABSTRACT

A device for making folded products, which is usable to simultaneously make two different folded products, includes a plurality of partial paper web train fold formers arranged on lower and upper levels and a double wide folding station. The fold formers located in the upper level are shiftable in the direction of the axis of rotation of the cylinders in the folding station. This axial movement of the upper level fold formers allows the production of various folded products having different signature arrangements by the insertion of the partial web trains from the upper level fold formers into either the right or left sides of the double wide folding station.

4 Claims, 4 Drawing Sheets

CROSS FOLDING DEVICE WITH SHIFTABLE FORMERS

FIELD OF THE INVENTION

The present invention is directed generally to a device for making folded products. More particularly, the present invention is directed to a device for making folded products which uses a plurality of fold formers disposed on two levels. Most specifically, the present invention is directed to a device for making folded products in which fold formers on an upper level are shiftable with respect to the fold formers on a lower level. The plurality of fold formers each can form a folded partial paper web train. All of the paper web trains are cut in a transverse double wide cutting cylinder and are delivered to either a left or right transverse folding station. The various partial paper trains can be combined or associated together, prior to being cut and folded into signatures, in various combinations. Each of the partial paper webs can take a pre-selected position in the main train or can be kept separate from the main train.

DESCRIPTION OF THE PRIOR ART

It is known generally in the prior art to provide fold formers on plural levels and to combine the several paper trains into a single main train. In the German Patent Publication DE 41 28 797 A1 there is shown such a device. A plurality of partial paper web trains that consist of different webs are conducted over fold formers which are disposed on different levels. The positions of the partial folded paper web trains are varied in a main train. The main train is then transferred to a folding apparatus. In the folding apparatus the main train is provided with a transverse or cross cut and is also transversely folded.

A limitation of this type of prior art device is that it is usable to produce only a single product. This means that the number of pages in the single main paper train must be limited by the capability of the folding apparatus to properly transversely cut and fold the assembled main paper web train. The prior art device is also capable of producing only one transversely folded product. While the number of webs combined into the main paper train may be varied, the resulting product from the folding apparatus is a single folded product.

It will be seen that the prior devices for making folded products, which utilize fold formers on two levels, do not provide the user with a desired degree of flexibility for the selection of different products. The device for making folded products in accordance with the present invention provides such a device and is a significant improvement over the prior art devices.

SUMMARY OF THE INVENTION it is an object of the present invention to provide a device for making folded products.

Another object of the present invention is to provide a device for making folded products which has partial web fold formers on at least two levels.

A further object of the present invention is to provide a device for making folded products in which fold formers on an upper level are shiftable.

Still another object of the present invention is to provide a folding apparatus having a double wide cross cutting and transverse folding station.

Yet a further object of the present invention is to provide a folding apparatus with a large degree of variability in the arrangement of the folded products.

Even still another object of the present invention is to provide a folding apparatus wherein the number of layers of product may be varied.

As will be discussed in detail in the description of the preferred embodiment which is set forth subsequently, the device for making folded products in accordance with the present invention utilizes two fold formers on a first, lower level and two fold formers on a second, upper level. Each of these fold formers receives a partial paper web train which is either longitudinally folded or slit at its associated fold former. The two fold formers on the upper level are shiftable with respect to the two fold formers on the lower level. A double wide transverse folder, that includes a cutting blade cylinder, a folding blade cylinder and a folding jaw cylinder, is located beneath the fold formers. The upper level fold formers are shiftable in the axial direction of the transverse folding apparatus. The folding station delivers cross-folded products to the left and right paddle wheels and delivery belts.

The device for making folded products in accordance with the present invention provides a number of advantages over the prior art devices. It is now possible to produce both a first and a second transversely folded product at the same time. For example, two complete newspapers or two initial products or a mixed product comprising a newspaper and an initial product can all be formed using the present invention. It is possible to form folded products from one, two, three, four, six or eight signatures by means of the two fixed fold formers and the two longitudinally or axially shiftable fold formers which are disposed above the fixed fold formers. The various partial paper web trains can be placed in different positions in the assembled train. Thus the final folded product can have a variety of different partial train arrangements by selecting different routings of the partial trains from the upper level, displaceable fold formers. This allows two folded products of the same or of differing thicknesses; i.e. folded products with the same or with different numbers of layers to be produced, each time with the full use of the capability of the double wide folding apparatus. This avoids the need for expensive upper structures.

The device for making folded products in accordance with the present invention facilitates the production of folded products with a maximum of eight signatures and with a maximum of 96 pages which can be produced in single production. Folded products with a maximum of four signatures and with maximally twice 96 pages can be made in double production. If the subject device is further provided with two fold formers disposed next to each other on three levels, the number of the individual signatures supplied to the folding apparatus can be again increased. It is also possible, in accordance with the present invention to produce folded products which have only one transverse fold.

The device for making folded products in accordance with the present invention provides far greater flexibility than was afforded by the prior art devices. It is a substantial advance in the art.

BRIEF DESCRIPTION OF THE DRAWINGS

While the novel features of the device for making folded products in accordance with the present invention are set forth with particularity in the appended claims, a full and complete understanding of the invention may be had by referring to the detailed description of the preferred embodiment which is set forth subsequently, and as illustrated in the accompanying drawings, in which:

DETAILED DESCRIPTION OF THE PREFERRED EMBODIMENT

Figure 1:
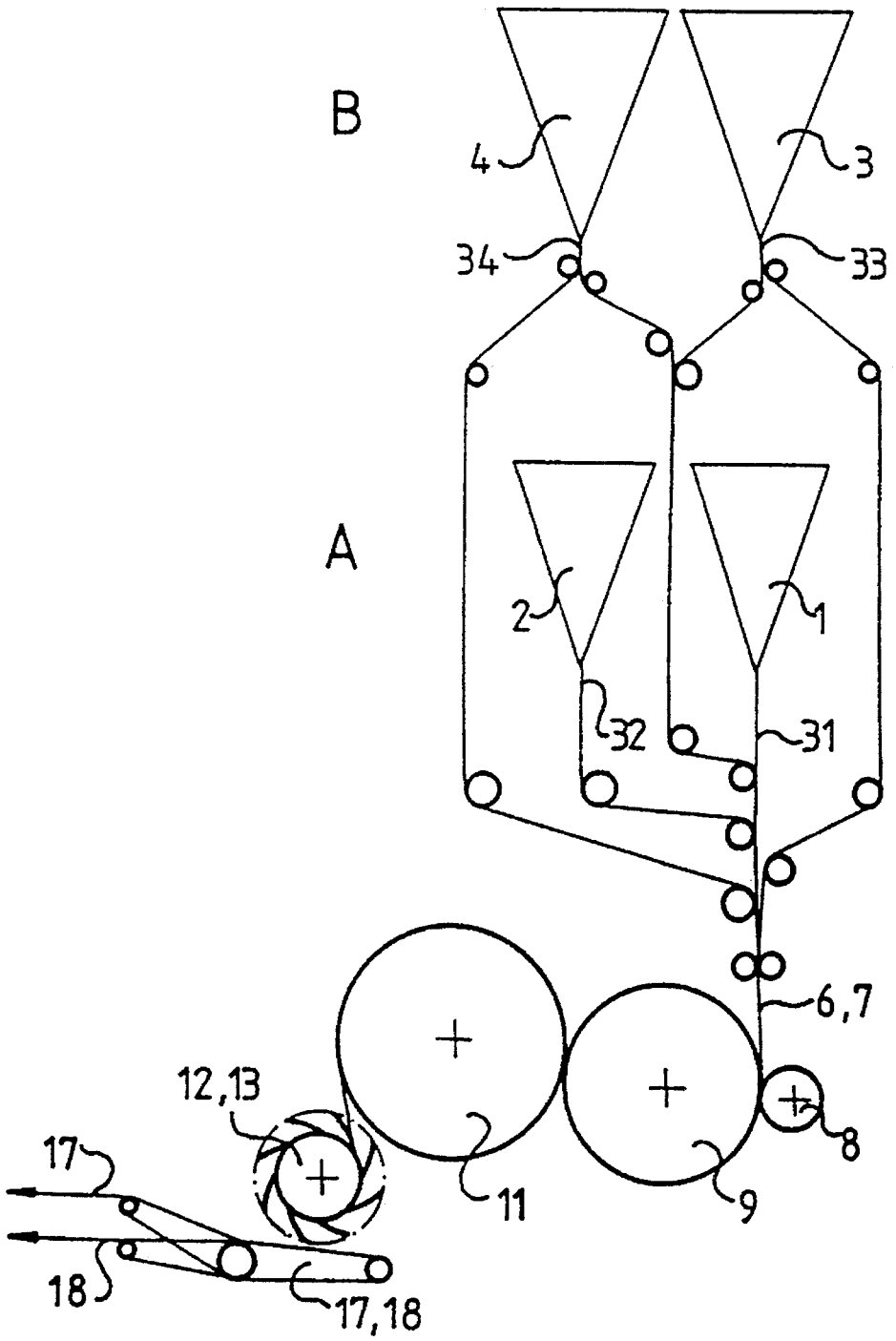
FIG. 1 is a schematic side elevation view of a double wide folding apparatus with fold formers disposed above it, in accordance with the present invention.

Referring initially to FIG. 1, there may be seen a side elevation view of a preferred embodiment of a device for making folded products in accordance with the present invention. The device of the present invention is intended for use in a web-fed rotary printing press that produces a plurality of printed paper webs. These several printed paper webs or partial paper trains are all directed to the device in accordance with the present invention. There they are combined as desired, are cross cut and are folded into signatures. Since the present invention resides in the device for making folded products and not in the printing press, there will not be any discussion regarding the press itself or its operation. It will be understood that these are generally conventional.

Figure 2:
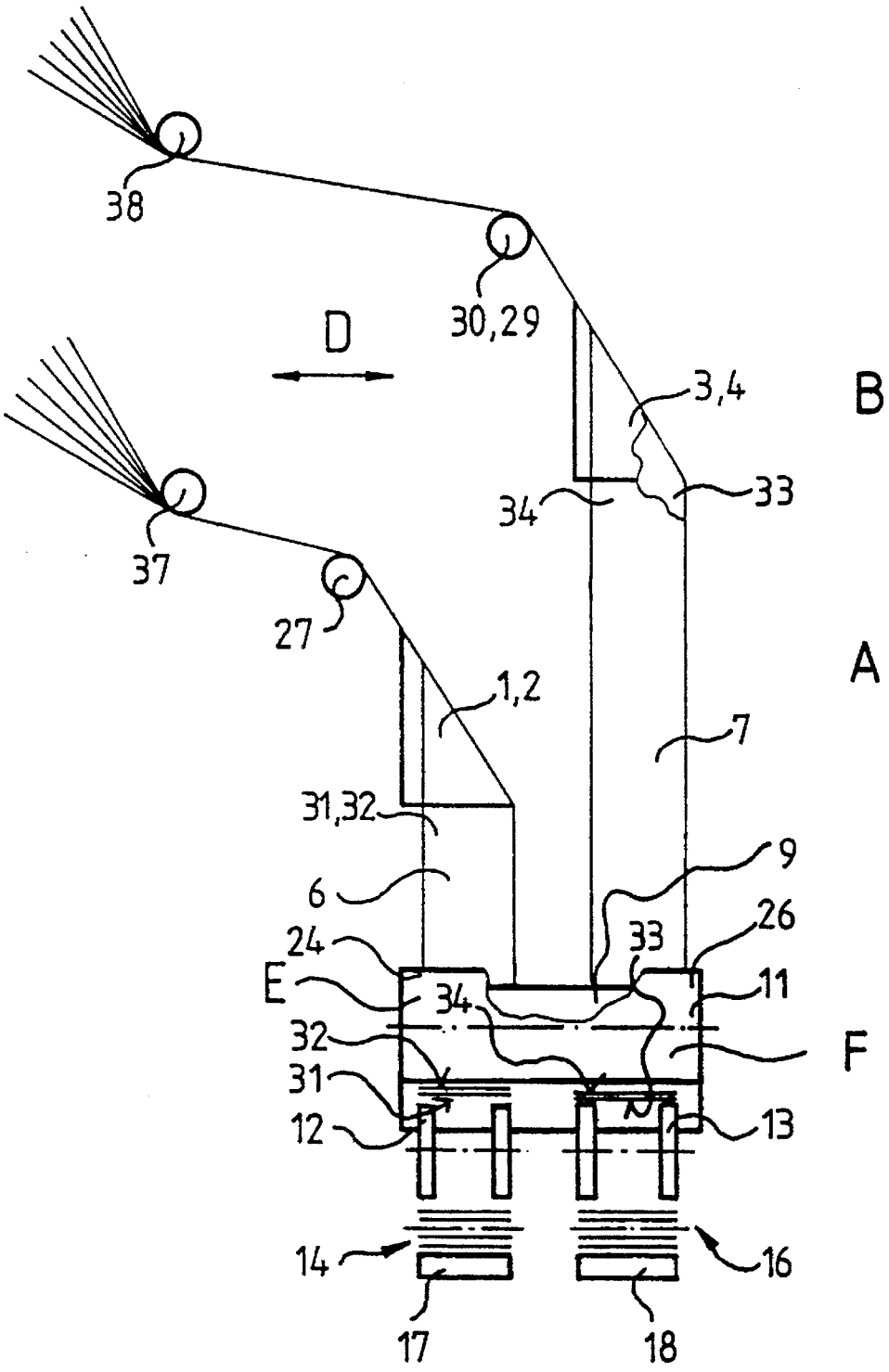
FIG. 2 is a front elevation view of the device shown in FIG. 1 and with the upper displaceable fold formers in a first position.
Figure 3:
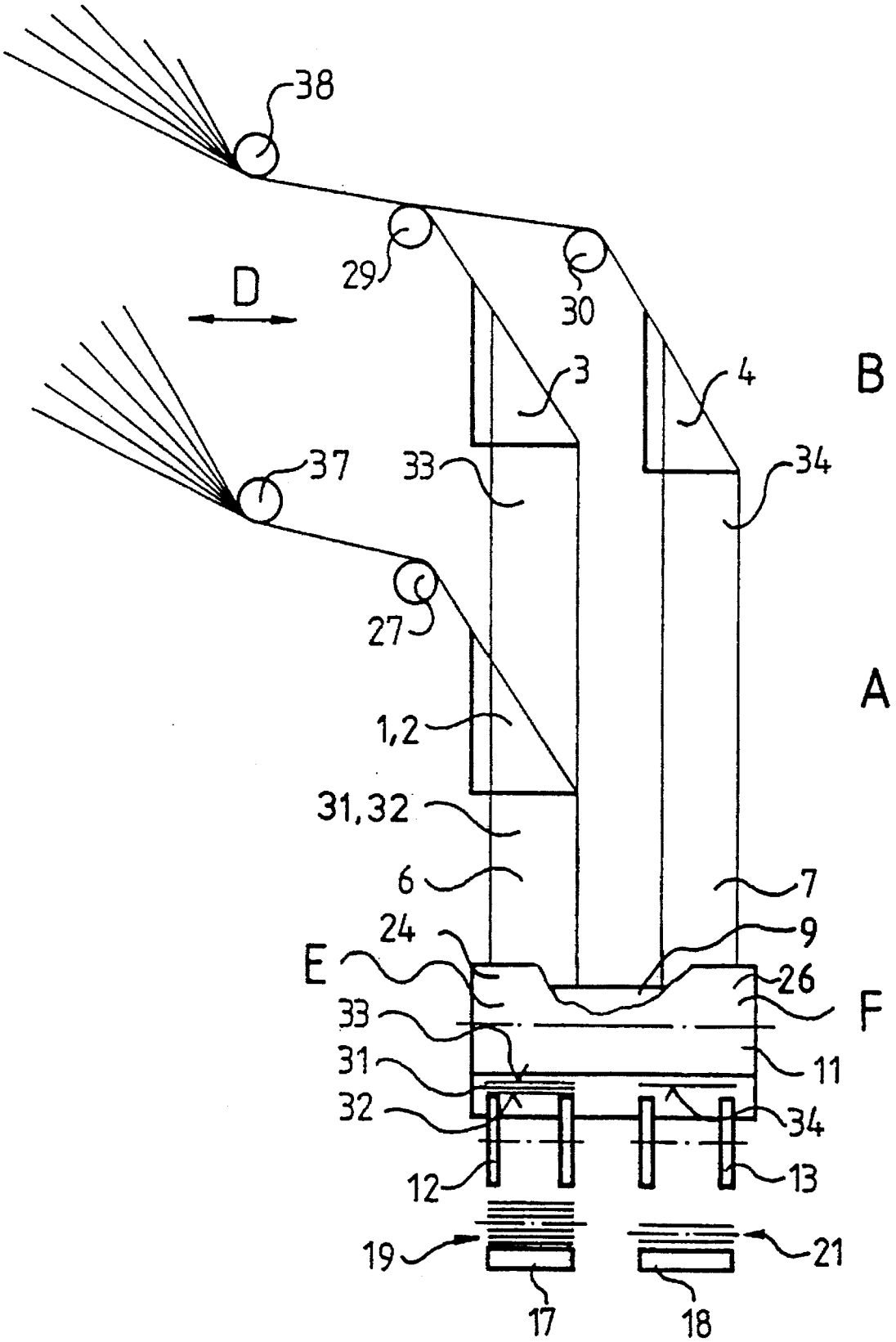
FIG. 3 is a view similar to FIG. 2 and showing the upper, displaceable fold formers in a second position.
Figure 4:
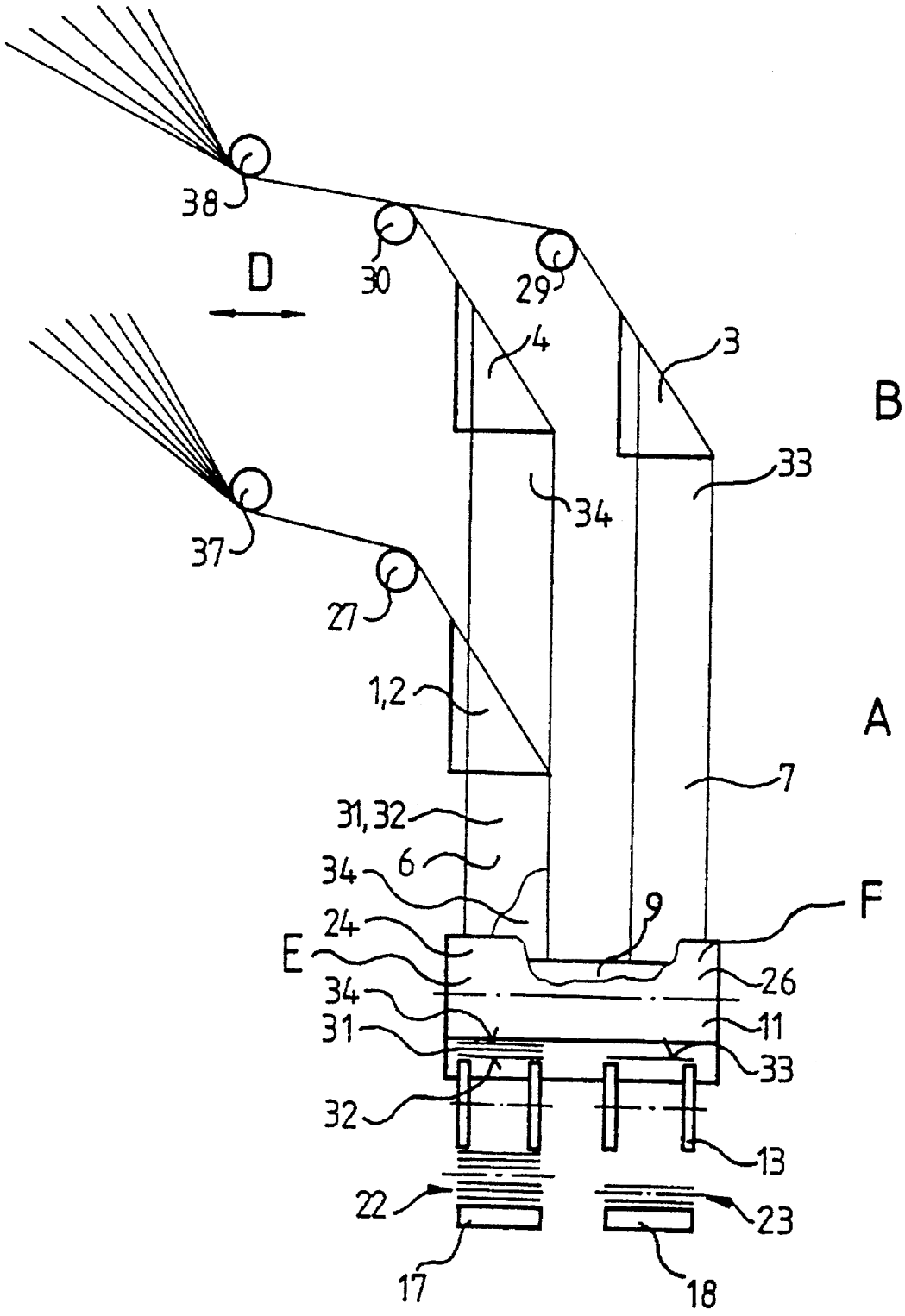
FIG. 4 is a view similar to FIGS. 2 and 3 and showing the displaceable fold formers in a third position.

As may be seen most clearly in FIG. 1, and as is also shown in FIGS. 2–4, two fold formers 1 and 2 are fixedly disposed next to each other on a first or lower level A. Two displaceable fold formers 3 and 4 are disposed next to each other on a second level B which is located above the first level A. One partial paper web train 31, 32, 33 or 34 emerges from the exit of each of the fold formers 1, 2, 3 and 4; runs over rollers not shown in detail, and is combined with the other partial trains into a main train 6 or into two main trains 6, 7, which enter a folding apparatus. The folding apparatus consists of, for example, a two-section cutting cylinder 8 which operates in cooperation with a seven-section cylinder 9 with cutting grooves, point spurs and folding blades. A seven-section folding jaw cylinder 11 follows the folding blade cylinder 9. Each of the cylinders 8, 9 and 11 is embodied to be double-wide and it is possible to dispose two devices such as cutting blades, folding blades or folding jaws in the axial direction on each cylinder 8, 9 or 11 and to provide them with one drive element, but with separately controlled known folding devices. This means that two partial paper web trains 31, 32, 33 or 34 emerging from the outlets of the fold formers 1 to 4 can be disposed next to each other in the axial direction of the cylinders 8, 9, 11 and on the jacket surfaces of the cylinders 8, 9, 11. It is also possible to structure the cylinder 9 and 11 to each have five sections. Two paddle wheels 12 and 13 are disposed next to each other in the axial direction underneath the folding jaw cylinder 11, which places the folded products 14 and 16 made by the folding apparatus on one of two delivery belts 17 and 18. In this case, the delivery belt 17 is associated with the paddle wheel 12 and the delivery belt 18 with the paddle wheel 13.

Turning now primarily to FIGS. 2–4, the upper fold formers 3 and 4 which are located on the second level B, can be displaced in the axial direction of the cylinders 8, 9, 11 of the folding apparatus, as indicated by arrow D in FIGS. 2–4, and so that the fold formers 3 and 4 selectively cooperate with one or both of the left and right transverse folding stations, indicated by E and F, at the left and right inlets 24, 26 of the folding apparatus which are disposed next to each other. In this case, the left transverse folding station E is located above the left inlet 24 and the left paddle wheel 12, and the right transverse folding station F is located above the right inlet 26 and the right paddle wheel 13.

In accordance with the representation of the present invention, as seen in FIG. 1, a partial paper web or train 33 or 34, consisting of different printed webs, can be brought to different stations as the folded product 14, 16. If, for example, a folded product 14 made of four partial trains 31 to 34 is produced only at the left transverse folding station E, the partial trains 31 to 34 can have the following sequence on the jacket surface of the folding blade cylinder 9 which is equipped with cutting grooves, point spurs and folding blades: 32, 34, 31, 33; 34, 32, 33, 31; 34, 32, 31, 33; 32, 34, 33, 31, depending on where the partial trains 33 and 34 emerging from the displaceable fold formers 3 and 4 are inserted. These various options are depicted schematically in FIG. 1.

A schematic front view of the device for making folded products, in accordance with FIG. 1, is represented in FIG. 2, in which the lower level fixed fold formers 1 and 2, located on the first level A, cooperate with the left inlet 24 of the folding apparatus symbolically represented by the folding jaw cylinder 11. In the process of operation, the signatures of the partial trains 32 and 31 are received in the sequence 32, 31 in the left inlet 24 on the jacket surface of the folding jaw cylinder 11 during the transverse folding process. The upper level displaceable fold formers 3, 4 disposed on the second level B, cooperate with the right inlet 26 of the folding apparatus. The signatures of the partial trains 34 and 33 are received in the sequence 34, 33 in the right inlet 26 on the jacket surface of the folding jaw cylinder 11. The first folded product 14, deposited on the delivery belt 17, has the following sequence of signatures from top to bottom: 31, 32, 32, 31. The second folded product 16, deposited on the delivery belt 18, has the following sequence of signatures from top to bottom: 33, 34, 34, 33.

In accordance with the representation of the present invention in FIG. 3, a displaceable fold former 3 is in the left transverse folding station E above the left inlet 24, and a displaceable fold former 4 is in the right transverse folding station F above the right inlet 26 of the folding apparatus. In this case the signatures of the partial trains 33, 31, 32 are received one after the other on the jacket surface of the folding jaw cylinder in the transverse folding station E, which results in the sequence 33, 31, 32, 32, 31, 33 of the signatures in a folded product 19 deposited on a delivery belt 17. The second displaceable fold former 4 cooperates by itself with the right cross folding station F of the folding apparatus, so that here a folded product 21 is formed from the signatures of the partial train 34.

In accordance with the representation of the present invention, as seen in FIG. 4, the displaceable fold formers 3, 4 have exchanged their positions from those depicted in FIG. 3. The fold former 4 is now at the left transverse folding station E and the fold former 3 is now at the right transverse folding station F above the folding apparatus. The fold former 3 operates by itself at the right transverse folding position F above the right inlet 26 of the folding apparatus, so that a folded product 23 is formed from only the signatures of the partial train 33. The sequence of the signatures of the partial trains arriving at the left folding position E on the folding jaw cylinder 11 is as follows: 34, 31, 32, which results in the sequence 34, 31, 32, 32, 31, 34 of the signatures in a folded product 22 which is then deposited on a delivery belt 17. It is also possible, in accordance with the present invention, to let all of the four partial paper web trains 31 to 34 run into the left transverse folding station E of the folding apparatus in order to obtain only a single folded product consisting of four partial trains 31 to 34.

Fold former inlet rollers 27, 29 and 30, which are fixed on the fold formers and which are associated with the fold formers 1 to 4, are represented in FIGS. 2 to 4. The fold formers 3 and 4 can be displaced on rails, not shown, fixed on the frame. Fold former pre-inlet rollers 37 and 38, which are also shown in FIGS. 2–4, are secured on the frame. The fold former pre-inlet rollers 37 and 38, as well as the fold former inlet roller 27 are embodied to be double-wide to receive two adjoining partial trains. It is furthermore possible to increase the number of signatures in case of a single production. It is also possible to dispose two additional displaceable fold formers on a third highest level C, not shown, while the fold formers 3, 4 on the second level B and the two fold formers 1, 2 on the level A are fixedly installed. With the same number of webs, this would increase the number of partial trains, which might be desirable.

The folding blade cylinder 9, which is provided with cutting grooves, point spurs and folding blades, can also be designed without cutting grooves. A belt guide system, not shown, can be disposed on the circumference of the folding blade cylinder 9 in place of the cutting cylinder 8. In this configuration, the main paper web trains 6 and 7 would be cut into signatures by means of two cutting cylinders that would be disposed upstream of the folding cylinder group 9. It is also possible to cut the partial paper web trains 31 to 34 longitudinally and to let them run through the fold formers 1 to 4 in such a way that no longitudinal fold is created thus resulting in so-called tabloid production. The "double-wide" point spur and folding blade cylinder 9 as well as the "double-wide" folding jaw cylinder 11 can be accomplished wherein a "double width", that is created by means of a one-piece double-wide point spur and folding blade cylinder 9 and a one-piece double-wide folding jaw cylinder 11, is used. In the same way, a "double-width" of the above named cylinders 9 and 11 of the folding group can be obtained by using two separate cylinders disposed next to each other and provided with separate drive elements.

While a preferred embodiment of a device for making folded products in accordance with the present invention has been set forth fully and completely hereinabove, it will be apparent to one of skill in the art that a number of changes in, for example, the overall sizes of the cylinders, the specific drives for the cylinders, the type of printing press used and the like could be made without departing from the true spirit and scope of the present invention which is accordingly to be limited only by the following claims.

What is claimed is:

1. A device for making folded products in a web-fed printing press, said device comprising:

a first group of fold formers secured adjacent each other on a lower level and a second group of fold formers movably positioned adjacent each other on an upper level, each of said first formers in said first and second groups of fold formers receiving a partial paper web train having a first width; and a transverse folding apparatus having a folding blade cylinder and a folding jaw cylinder, each of said cylinders in said transverse folding apparatus having a second width twice said first width, said cylinders being rotatable about parallel axes of rotation, said transverse folding apparatus having a left inlet and a right inlet, said second group of fold formers being shiftable individually in a direction of said axes of rotation to align said partial paper web trains from said fold formers in said second group of fold formers to be insertable individually or together into said left inlet or said right inlet of said transverse folding apparatus.

2. The device for making folded products in accordance with claim 1 wherein said partial paper web trains are longitudinally folded prior to being inserted into said transverse folding apparatus.

3. The device for making folded products in accordance with claim 1 wherein each of said fold formers in said second group is separately movable in said direction of said axes of rotation.

4. A device for making folded products comprising:

first and second fold formers securely disposed adjacent each other on a first level and operable to receive first and second partial paper web trains each having a partial web width;

third and fourth fold formers shiftably disposed adjacent each other on a second level above said first level and operable to receive third and fourth partial paper web trains having said partial web width; and a transverse folding apparatus including a folding blade cylinder and a folding jaw cylinder, each of said cylinders being rotatable about an axis of rotation, said folding blade cylinder axis of rotation and said folding jaw cylinder axis of rotation being parallel to each other, each said folding jaw cylinder and said folding blade cylinder having a cylinder width, said cylinder width being twice said partial web width, said transverse folding apparatus having a left inlet and a right inlet, each of said third and fourth fold formers being shiftable in a direction parallel to said axes of rotation to position each of said third and fourth partial paper web trains for selective insertion into said left or right inlet of said transverse folding apparatus.

* * * * *